United States Patent [19]

Wilson

[11] Patent Number: 4,580,352

[45] Date of Patent: Apr. 8, 1986

[54] FOLDABLE TEMPLATE FOR LAYING OUT STAIRWAY STRINGERS AND METHODS OF USING THE SAME

[76] Inventor: Carl O. Wilson, Box 218, Gilchrist, Tex. 77617

[21] Appl. No.: 682,369

[22] Filed: Dec. 17, 1984

[51] Int. Cl.[4] ..... B43L 7/06; B43L 13/24

[52] U.S. Cl. ..... 33/563; 33/478

[58] Field of Search ..... 33/1 G, 403, 411, 415, 33/416, 452, 456, 458, 478, 562, 563, 565, 566

[56] References Cited

U.S. PATENT DOCUMENTS

| | | | |
|---|---|---|---|
| 134,919 | 1/1873 | Moore | 33/478 |
| 707,307 | 8/1902 | Doyle | 33/473 |
| 1,277,873 | 9/1918 | Crate | 33/563 |
| 2,494,462 | 1/1950 | Van Winkle | 33/93 |
| 2,713,203 | 7/1955 | Gottlieb | 33/563 |
| 2,879,556 | 3/1959 | Lyons | 33/562 |
| 3,015,164 | 1/1962 | Antell | 33/102 |
| 3,478,434 | 11/1969 | Catalano | 33/93 |

FOREIGN PATENT DOCUMENTS

| | | | |
|---|---|---|---|
| 536038 | 3/1955 | Belgium | 33/456 |
| 960232 | 3/1957 | Fed. Rep. of Germany . | |

*Primary Examiner*—Richard R. Stearns

*Attorney, Agent, or Firm*—Shapiro and Shapiro

[57] ABSTRACT

A foldable template for laying out stairway stringers includes a plurality of step-defining members each having, in fixed relation, a tread-defining edge and a rise-defining edge and, for each pair of successive step-defining members, a corresponding intermediate member which is foldably attached to the respective successive step-defining members so that the step-defining and intermediate members of said template may be folded one upon another to form a compact stack. For use, the template is unfolded to provide, lengthwise, a number of step-defining members corresponding to the steps of a stringer. The template is then placed flat on a workpiece from which the stringer is to be cut, and the tread-defining and rise-defining edges are marked off on the workpiece which is thereafter cut along the marked off portions to yield the stringer.

21 Claims, 4 Drawing Figures

FOLDABLE TEMPLATE FOR LAYING OUT STAIRWAY STRINGERS AND METHODS OF USING THE SAME

BACKGROUND OF THE INVENTION

This invention relates to tools for use in stairway construction and is more particularly concerned with an improved tool for laying out stairway stringers and methods of using the same.

In one of the most commonly used procedures for constructing stairway stringers, the distance is measured between a preselected pair of points corresponding to the head and foot of a stairway, and then a stringer is laid out on a workpiece (usually a straight section of board) by successively positioning a carpenter's square along an edge of the board to mark off the individual steps of the stringer. Once a number of steps spanning the measured distance has been marked off, the board is cut along the marked steps to yield the stringer.

Because the carpenter's square must be consistently positioned with great precision to ensure that the individual steps are uniformly defined when a stringer is laid out, the construction of stringers in accordance with the foregoing procedure is tedious, time-consuming and expensive. This procedure also suffers a further disadvantage in that there is no simple way for the carpenter to determine from the measured distance whether a whole number of steps with given tread and rise dimensions will fit precisely between the preselected end points of the stairway. Consequently, in practice, many carpenters will actually fix the end points (such as by constructing landings or laying footings) without knowing whether the distance between them is suitable to accommodate a uniform stairway. It is only when they lay out a stringer that they discover the selected end points are unsuitable. In many such cases, because it would be unreasonably expensive to alter the fixed end points, the stringers are modified at one or both ends to fit between those points. Such modifications are highly undesirable, however, because the resulting non-uniformity among the individual steps can cause users of the finished stairway to stumble, thus presenting a risk of serious injury.

SUMMARY OF THE INVENTION

The present invention avoids the above-noted problems by providing a tool which permits the layout of a stairway stringer in its entirety. More particularly, the invention provides a template which includes a plurality of step-defining members so that all steps of a stringer may be marked off with no movement of the template being required after initial placement on the board from which the stringer is to be cut.

Since the stringer can be accurately laid out in its entirety, a considerable saving of time and labor is achieved. Additionally, because the template corresponds to a complete stringer, the carpenter can readily determine whether a whole number of steps will fit precisely between a selected pair of end points simply by checking the distance between the end points against the template. The end points may then be fixed with complete assurance of their suitablility for a safe and proper stairway. For convenience in storage and transport, the template is constructed so that it may be folded into a compact arrangement.

Briefly stated, according to one aspect of the invention, the template may comrise a plurality of step-defining members each having, in fixed relation, a tread-defining edge and a rise-defining edge and, for each pair of successive step-defining members, a corresponding intermediate member which is foldably attached to the respective successive step-defining members so that the step-defining and intermediate members of the template may be folded one upon another to form a compact stack.

According to another aspect of the invention, the template may comprise a plurality of substantially flat step-defining members each having a base edge, a tread-defining edge parallel to the base edge, a side edge perpendicular to the base edge and a rise-defining edge transverse to the base edge, with each pair of successive step-defining members joined by a corresponding intermediate member having perpendicular first and second edges, the first and second edges being connected, respectively, to the base edge of one of the corresponding step-defining members and the side edge of the other corresponding step-defining member so that the corresponding step-defining members may be folded to respective opposite sides of the intermediate member. In a preferred embodiment, the intermediate members are connected to the corresponding step-defining members by hinge means, the step-defining members are of a rectangular shape, and the intermediate members are of a right-triangular shape.

Yet another aspect of the invention relates to a method of using the template to lay out stairway stringers. The method may include the steps of providing a foldable template of the inventive type, unfolding the template to provide, lengthwise, a number of successive step-defining members corresponding to the steps of the stringer, placing the template flat on a workpiece from which the stringer is to be cut, marking off the tread-defining and rise-defining edges on the workpiece, and cutting the workpiece along the marked-off portions.

The features and advantages of the invention will become more fully apparent to those skilled in the art from the ensuing description of the preferred embodiments taken in conjunction with the accompanying drawings.

DETAILED DESCRIPTION OF THE PREFERRED EMBODIMENTS

Figure 1:
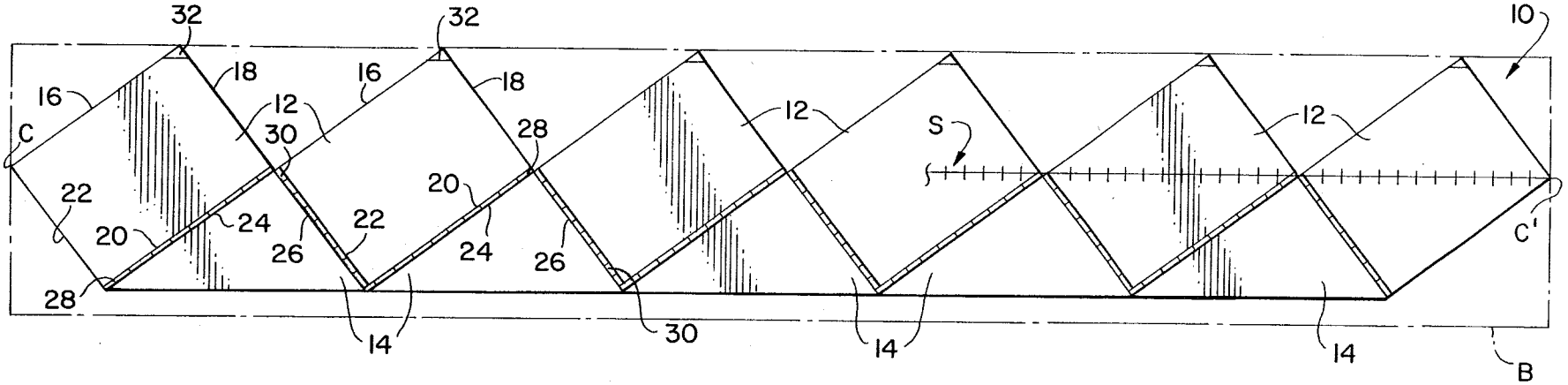
FIG. 1 is a diagrammatic plan view of a foldable template in accordance with the invention in an unfolded configuration for laying out a stairway stringer.

FIG. 1 shows an exemplary foldable template 10 in accordance with the present invention, the template being depicted in place on a board B for laying out a stringer. In the form shown, template 10 comprises a plurality of substantially flat step-defining members 12, with each pair of successive members 12 being foldably connected to a corresponding substantially flat intermediate member 14. As in the case of the illustrative template 10, in most practical embodiments of the invention, the step-defining members 12 will be of substantially identical dimensions, as will the intermediate members 14. Members 12 and 14 may be made of any material having sufficient stiffness to permit tracing of the template perimeter with a pencil or the like, sheet metal and hard plastics being suitable for this purpose. While the illustrative embodimemt of FIG. 1 includes six step-defining members, it will be apparent that any convenient number of step-defining members may be used in practice along with an appropriate number of intermediate members.

With continued reference to FIG. 1, it will be seen that each of the step-defining members 12 has a tread-defining edge 16 and a rise-defining edge 18. The step-defining members 12 preferably have a quadralateral shape, herein being shown as rectangular, with a base edge 20 parallel to the tread-defining edge 16 and a side edge 22 perpendicular to the base and tread-defining edges. In practical embodiments of the invention, the tread-defining and rise-defining edges will, of course, generally have dimensions suitable to a stairway for use by adults. For example, tread-defining edges 16 may be of the order of 9 inches in length, and rise-defining edges 18 may be of the order of 7 inches in length.

Figure 3:
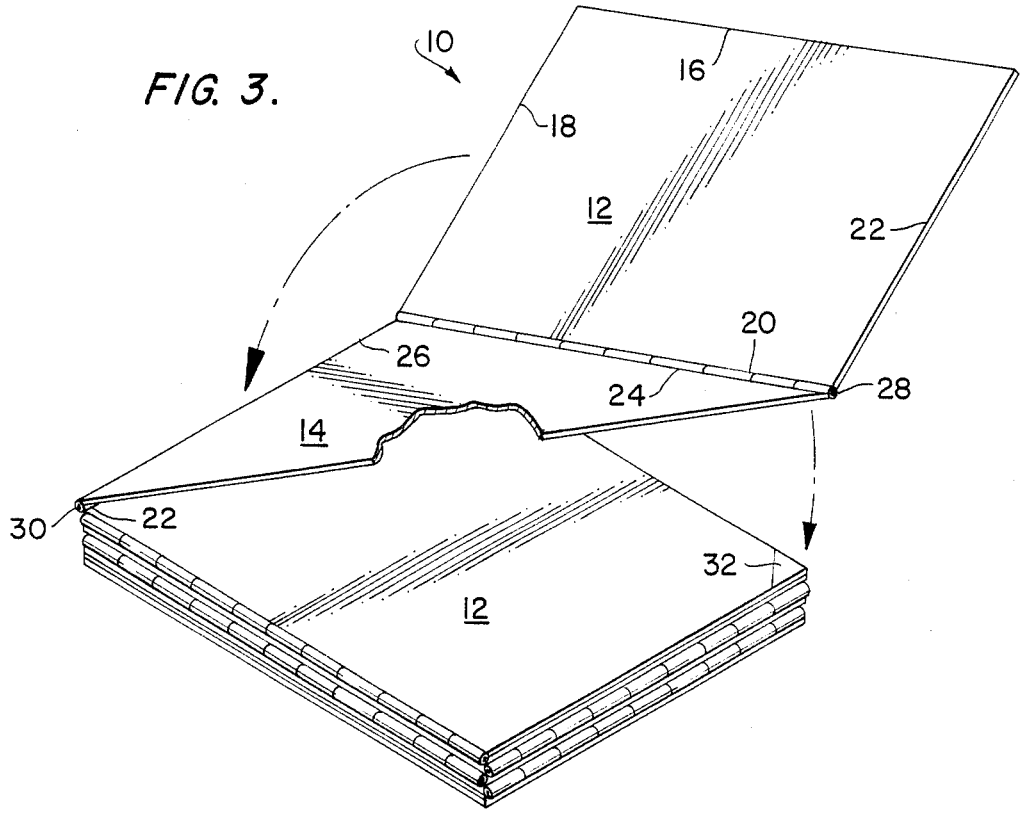
FIG. 3 is a perspective view illustrating the manner in which the template is folded for storage.

Each intermediate member 14 is preferably in the form of a right triangle with perpendicular first and second edges 24 and 26, as shown. For connecting the corresponding pair of successive step-defining members 12, the first edge 24 of each intermediate member is foldably connected by means of a piano hinge 28 to the base edge 20 of one of the corresponding successive members 12, while the second edge 26 is connected by another piano hinge 30 to the side edge 22 of the remaining successive step-defining member. The hinges 28 and 30 are constructed to swing in opposite directions relative to the plane of FIG. 1 so that each pair of successive step-defining members 12 can be folded to opposite sides of the corresponding intermediate member 14. Hence, as shown in FIG. 3, the step-defining and intermediate members of template 10 may be folded one upon another to form a compact stack for convenient storage. As will be apparent from FIG. 1, the edges 24 and 26 of the intermediate members 14 may have substantially the same lengths as the corresponding edges 20 and 22 to which they are connected in order to provide a substantially continuous bottom edge for the template when it is unfolded.

Figure 2:
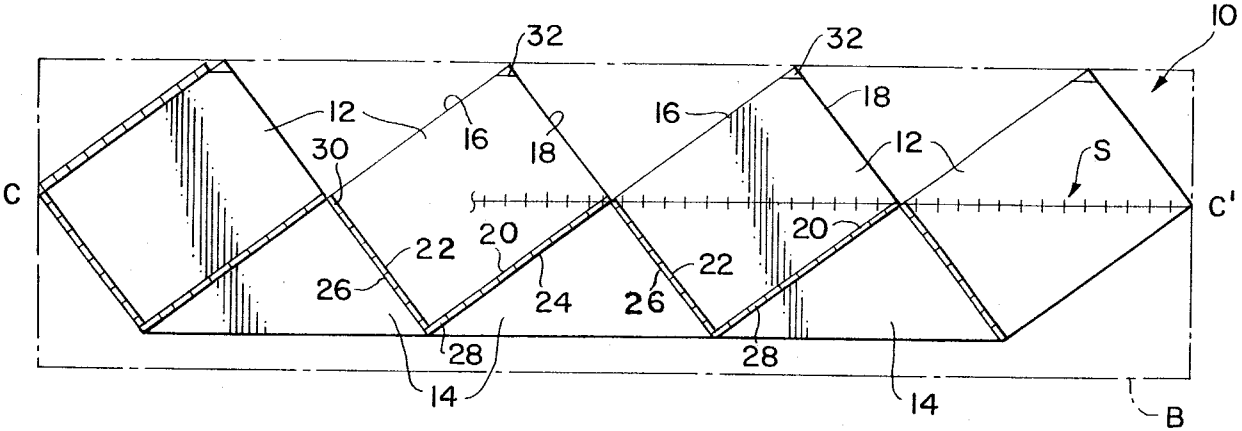
FIG. 2 is a view similar to FIG. 1, with the template being partially unfolded for defining a stringer with fewer steps.

To utilize template 10 for laying out a stairway stringer, the template is simply unfolded to expose the desired number of step-defining members and then laid on a board of appropriate dimensions. FIG. 1, for example, illustrates template 10 in a completely unfolded condition on a board B for defining a stringer six steps in length, whereas FIG. 2 shows the same template unfolded only to the extent required to lay out a stringer having just four steps on another board B. As seen in both FIGS. 1 and 2, the template is placed flat on the appropriate board with the points of intersection of the tread-defining and rise-defining edges 16 and 18 of the respective members 12 aligned along an edge of the board. Indicator marks 32 may be painted or otherwise provided at these intersection points to facilitate alignment. Once the template is properly located, it is simply necessary to mark off the perimeter of the template on the board and then to cut the board along the marked off portions. All of the steps of the resulting stringer will have precisely the desired dimensions corresponding to the tread and rise-defining edges 16 and 18.

It will now be appreciated that by use of the template 10 any carpenter, professional or amateur, can lay out and construct stairway stringers both quickly and accurately. Also, because the template eliminates the possibility of error associated with marking off the individual steps by successively positioning a carpenter's square, the user will obtain consistently accurate results.

Moreover, as was noted earlier, the template provides a tool whereby the suitability of an initially selected pair of stairway end points may be easily determined from the distance between those points. This may be done simply by laying out the same distance along a line extending between the corners C, C′ at opposite lengthwise ends of the template. If this distance, when layed out from one end of the template, does not extend precisely to the opposite end of the template or to the junction of a pair of edges 16, 18 of successive step-defining members 12, the selected end points will not accommodate a whole number of steps having the tread and rise of the template members 12. If desired, a measurement scale S may be provided on the template along the aforementioned line for convenience, as shown in FIGS. 1 and 2.

Figure 4:
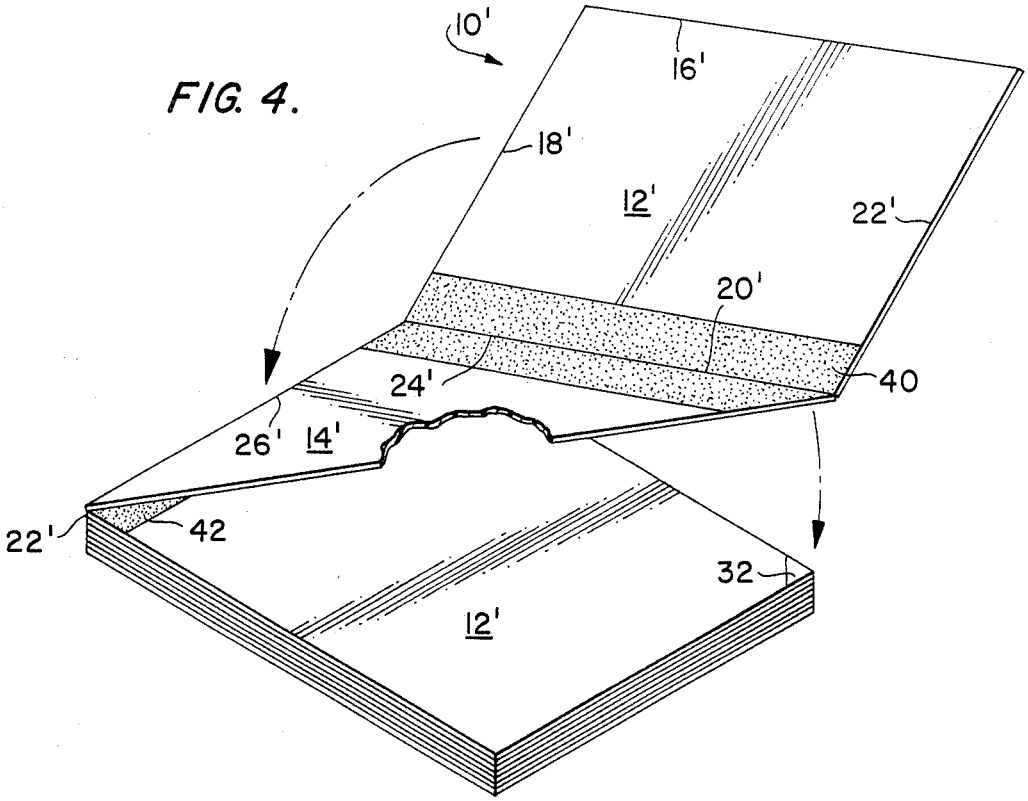
FIG. 4 is a view similar to FIG. 3, showing another embodiment of the template.

FIG. 4 shows another embodiment of the invention having the same basic construction as template 10 shown in FIGS. 1–3, except that the piano hinges of the previous embodiment have been replaced by adhesive strip material. Briefly, in FIG. 4 (wherein primed reference numerals have been used to denote elements corresponding to those in FIGS. 1–3), it will be seen that edges 20′ and 22′ of step-defining members 12′ are respectively hingedly attached by means of adhesive strips 40 and 42 to the corresponding edges 24′ and 26′ of intermediate members 14′. The adhesive strips 40 and 42 may be in the form of transparent vinyl tape or any other material which will similarly provide a long-lasting hinged connection between the template members. It will be noted that in order to permit each pair of successive step-defining members 12′ to be folded to opposite sides of the corresponding intermediate member 14′, strips 40 and 42 are attached to respective opposite sides of the intermediate member 14′.

While preferred forms of the invention have been shown and described herein, it will be readily apparent to those skilled in the art that various changes and modifications can be made without departing from the principles of the invention, the scope of which is defined in the appended claims.

I claim as my invention:

1. A foldable template for laying out stairway stringers, comprising a plurality of step-defining members each having, in fixed relation, a tread-defining edge and a rise-defining edge and, for each pair of successive step-defining members, a corresponding intermediate member which is foldably attached to the respective successive step-defining members, the step-defining and intermediate members of said template being shaped and foldably attached in a manner such that said step-defining and intermediate members may be folded one upon another to form a compact stack.

2. A template in accordance with claim 1, wherein said step-defining members are substantially flat with four edges, said four edges including said tread-defining edge and said rise-defining edge, a base edge, a base edge parallel to said tread-defining edge, and a side edge perpendicular to said base and tread-defining edges, said rise-defining transverse to said base and tread-defining edges.

3. A template in accordance with claim 2, wherein said four edges form a quadralateral.

4. A template in accordance with claim 3, wherein said quadralateral is a retangle.

5. A template in accordance with claim 2, wherein said intermediate member has a right triangular shape.

6. A template in accordance with claim 2, wherein each intermediate member has perpendicular first and second edges respectively hingedly connected to the base edge of one of the corresponding pair of successive step-defining members and the side edge of the other step-defining member of that pair, so that the respective step-defining members may be folded to opposite sides of the corresponding intermediate member.

7. A template in accordance with claim 6, wherein said first and second edges of said intermediate member are connected to the respective base and side edges by means of piano hinges.

8. A template in accordance with claim 6, wherein said first and second edges of said intermediate member are connected to the respective base and side edges by means of adhesive strip material.

9. A template in accordance with claim 2, wherein said tread-defining and rise-defining edges are of the order of 9 inches in length and 7 inches in length, respectively.

10. A foldable template for laying out stairway stringers, comprising a plurality of step-defining members each having a base edge, a tread-defining edge parallel to said base edge, a side edge perpendicular to said base edge and a rise-defining edge transverse to said base edge, with each pair of successive step-defining members joined by a corresponding intermediate member having perpendicular first and second edges, said first and second edges being foldably connected, respectively, to the base edge of one of said successive members and the side edge of the other of said successive members so that said successive members may be folded to respective opposite sides of the intermediate member.

11. A template in accordance with claim 10, wherein said first and second edges are respectively connected by hinge means to the base edge of said one successive member and the side edge of said other successive member.

12. A template in accordance with claim 11, wherein said hinge means comprises a pair of piano hinges.

13. A template in accordance with claim 11, wherein said hinge means comprises adhesive strip material.

14. A template in accordance with claim 10, wherein said stair-defining members have a quadralateral shape.

15. A template in accordance with claim 14, including a measurement scale along a line containing corners at opposite lengthwise ends of said template.

16. A template in accordance with claim 14, wherein said step-defining members have a rectangular shape.

17. A template in accordance with claim 10, wherein said intermediate member has a right triangular shape, with said first edge being substantially the same length as the stair-defining member base edge to which it is connected and said second edge being substantially the same length as the stair-defining member side edge to which it is connected.

18. A template in accordance with claim 10, wherein said tread-defining and rise-defining edges are of the order of 9 inches in length and 7 inches in length, respectively.

19. A method of laying out a stairway stringer, comprising providing a foldable template which includes a plurality of step-defining members each having a base edge, a tread-defining edge parallel to the base edge, a side edge perpendicular to the base edge and a rise-defining edge transverse to the base edge, with each pair of successive step-defining members joined by a corresponding intermediate member having perpendicular first and second edges, the first and second edges being foldably connected, respectively, to the base edge of one of the successive members and the side edge of the other of the successive members so that the successive members may be folded to respective opposite sides of the intermediate member;

unfolding said template to provide, lengthwise, a number of successive step-defining members corresponding to the steps of the stringer;

placing said template flat against a workpiece from which the stringer is to be cut;

marking off, on the workpiece, the tread-defining and rise-defining edges of the step-defining members corresponding to the steps of the stringer; and cutting the workpiece along the marked off portions thereof.

20. The method of claim 19, wherein each step-defining member of said template has a quadralateral shape, the method further including measuring the distance between a selected pair of end points for the stairway and laying out said distance along a line extending between corners at opposite lengthwise ends of said template.

21. The method of claim 19, wherein said workpiece has a straight edge and wherein said placing includes positioning said template so that a point of intersection of the tread-defining and rise-defining edges of each step-defining member is located along said straight edge.

* * * * *